United States Patent [19]

Watanabe et al.

[11] Patent Number: 4,857,120

[45] Date of Patent: Aug. 15, 1989

[54] HEAT-RESISTING STEEL TURBINE PART

[75] Inventors: Osamu Watanabe; Mituo Kawai, both of Yokohama; Kanzi Kawaguchi, Shizuoka, all of Japan

[73] Assignee: Kabushiki Kaisha Toshiba, Kawasaki, Japan

[21] Appl. No.: 4,273

[22] Filed: Jan. 6, 1987

Related U.S. Application Data

[63] Continuation of Ser. No. 742,302, Jun. 7, 1985, abandoned.

[30] Foreign Application Priority Data

Jun. 21, 1984 [JP] Japan ..... 59-126481

[51] Int. Cl.[4] ..... C22C 38/44

[52] U.S. Cl. ..... 148/325; 148/335

[58] Field of Search ..... 148/325; 420/67–69; 60/909

[56] References Cited

U.S. PATENT DOCUMENTS

| | | | |
|---|---|---|---|
| 2,905,577 | 9/1959 | Harris | 148/37 |
| 3,139,337 | 6/1964 | Boyle et al. | 420/69 |
| 3,767,390 | 10/1973 | Hahn | 75/128 W |
| 4,564,392 | 1/1986 | Ohhashi et al. | 420/69 |

FOREIGN PATENT DOCUMENTS

| | | | |
|---|---|---|---|
| 073021 | 2/1983 | European Pat. Off. . | |
| 1001131 | 2/1952 | France . | |
| 62425 | 7/1955 | France . | |
| 1140573 | 3/1957 | France . | |
| 404137 | 5/1962 | Japan . | |
| 462741 | 8/1966 | Japan . | |
| 53-140217 | 5/1977 | Japan . | |
| 55-110758 | 8/1980 | Japan | 75/128 W |
| 741935 | 12/1955 | United Kingdom . | |

*Primary Examiner*—Deborah Yee

*Attorney, Agent, or Firm*—Oblon, Spivak, McClelland, Maier & Neustadt

[57] ABSTRACT

A heat-resisting steel contains 0.08 to 0.15 percent by weight of carbon, over 0.2 to 0.6 percent of silicon, 0.3 to 0.8 percent of manganese, 0.6 to 1.2 percent of nickel, 9.5 to 11.0 percent of chromium, 0.7 to 1.5 percent of molybdenum, 0.15 to 0.27 percent of vanadium, 0.10 to 0.27 percent in total of niobium and/or tantalum, 0.03 to 0.08 percent of nitrogen, over 1.1 to 1.3 percent of tungsten, and iron for the remainder. The creep rupture strength of this heat-resisting steel is much higher than that of a prior art 12-Cr heat-resisting steel. A turbine component formed of the heat-resisting steel of the present invention has enough strength for use at a high temperature of 600° to 650° C.

5 Claims, No Drawings

HEAT-RESISTING STEEL TURBINE PART

This application is a continuation of application Ser. No. 742,302 filed June 7, 1985, abandoned.

BACKGROUND OF THE INVENTION

The present invention relates to a heat-resisting steel improved in creep rupture strength at high temperature, and a turbine part, such as blades and bolts of steam turbines, formed from the heat-resisting steel.

The maximum steam temperature and pressure currently used for driving steam turbines are 566° C. and 246 kg/cm$^2$, respectively. The steam temperature and pressure used are expected to be increased for higher thermal efficiency. These steam conditions require the material of parts constituting a turbine to have the high-temperature strength. For the improvement of the steam conditions, therefore, materials with increased high-temperature strength are being positively developed. Such development is essential to the blades and bolts, as well as to large-sized main components such as the rotor and casing.

The blades of a steam turbine are continually subjected to centrifugal force caused by high-speed rotation. If their material lacks in high-temperature strength, the blades will possibly suffer a creep deformation and bend backward against the rotor, interfering with stationary parts at their edges. Bolts used for closing up the upper and lower casings are initially subjected to a fixed clamping pressure attributed to elastic force. Normally urged by a steam pressure which acts on the casing, however, the bolts undergo a creep deformation such that the clamping pressure thereon is gradually reduced. If the clamping pressure becomes too low to maintain the sealed condition of the casing, thereby causing leakage of steam, or if the creep deformation is accumulated, the bolts may sometimes be broken themselves.

Thus, the material for the blades and bolts used at high-temperature parts of steam turbines is required to have an excellent creep characteristic, and heat-resisting steel of a steel system has conventionally been used for the material. Generally, the heat-resisting steel is less expensive and higher in normal-temperature toughness than any other heat-resisting steel with the same high-temperature strength. In addition, the former is higher in damping capability which is essentially required to a material for blades. In order to improve the high-temperature strength of the heat-resisting steel without spoiling those fundamental features thereof, various alloying components are added to the metal to strengthen the martensitic structure and to stabilize carbonitrides, thereby maintaining the high-temperature strength and structural stability to stand long time use at high temperature. In the aspect of the manufacturing, segregation of the alloying components will directly lower the high-temperature strength of the metal and, at the same time, produce undesirable ferrite around the alloying constituents. Therefore, a remelting process is introduced to prevent such segregation for homogenization of the structure.

Conventionally, 12-Cr-Mo-V-Nb steel specifically called H46 (Jessop-Saville H46 by Jessop-Saville Ltd. or Mel-Trol H46 by The Carpenter Steel Company) and 12-Cr-Mo-V-W steel called 422 (Crucible 422 by Crucible Steel Company of America) are used as the material for blades and bolts of steam turbines. Both these materials, however, have a creep rupture time ranging from about 200 to 300 hours at 600° C. and with 30 kg/mm$^2$ load. Such a creep strength cannot meet the requirement for the increase of steam temperature and pressure to improve thermal efficiency. Thus, there is a demand for the development of steel with improved high-temperature creep characteristic.

SUMMARY OF THE INVENTION

The object of the present invention is to provide a heat-resisting steel having a higher creep rupture strength than the prior art heat-resisting steels and adapted for use as the material for parts of steam turbines, especially blades and bolts, and a turbine part formed therefrom.

In order to achieve the above object, a heat-resisting steel according to the present invention essentially consists of a carbon content of 0.05 percent to 0.25 percent by weight, a silicon content of over 0.2 percent to 1.0 percent by weight, a manganese content of 1.0 percent or less by weight, a nickel content of 0.3 percent to 2.0 percent by weight, a chromium content of 8.0 percent to 13.0 percent by weight, a molybdenum content of 0.5 percent to 2.0 percent by weight, a vanadium content of 0.1 percent to 0.3 percent by weight, niobium and/or tantalum contents of 0.03 percent to less than 0.3 percent by weight in total, a nitrogen content of 0.01 percent to 0.2 percent by weight, a tungsten content of over 1.1 percent to 2.0 percent by weight, and an iron content basically constituting the remainder, and substantially has a tempered martensitic structure.

The creep rupture time of the heat-resisting steel according to the present invention is much longer than those of the prior art heat-resisting steels. Further, the heat-resisting steel of the invention will never be deteriorated in mechanical properties even at room temperature, so that it can serve as a very effective material for those components, such as blades and casing bolts of steam turbines, which should be subjected to a force at high temperature (600° to 650° C.). Moreover, a turbine part formed from the heat-resisting steel of the invention may have enough strength to stand use at a high temperature of 600° C. or more, ensuring improved high-temperature utility.

DETAILED DESCRIPTION OF THE INVENTION

A heat-resisting steel according to the present invention is developed as a result of a systematic study of 12-Cr-Mo-V-Nb steel and 12-Cr-Mo-V-Nb-W steel as prior art 12-Cr heat-resisting steels.

In the process of the development of the steel according to the present invention, alloying components, including carbon, silicon, manganese, nickel, chromium, molybdenum, vanadium, niobium, tantalum, nitrogen, and tungsten, were investigated and examined in detail for their influences on the creep rupture strength of the steel. Also, metallographic tests and studies were performed lest its ductility and toughness be lower than those of the prior art 12-Cr heat-resisting steels.

The results of the examination are given as follows:

(1) Carbon (C)

Carbon serves to stabilize the austenitic phase of the metal at the time of quenching and to produce carbides, thereby improving the creep rupture strength of the steel. To attain this, the carbon content needs to be 0.05 percent or more. If the carbon content exceeds 0.25 percent, however, the carbides produced will be so much that the creep rupture strength will be reduced. Thus, the carbon content may range from 0.05 to 0.25 percent, preferably from 0.08 to 0.15 percent.

(2) Silicon (Si)

Silicon is an essential element as a deoxidizer used in refining process. If the silicon content is 0.2 percent or less, the function will not be able to be fulfilled. If the content exceeds 1.0 percent, however, the delta-ferrite phase with lower strength will be caused. Thus, the silicon content may range from over 0.2 to 1.0 percent, preferably from over 0.2 to 0.6 percent.

(3) Manganese (Mn)

Manganese is an element which, like silicon, should be added as a deoxidizer and desulfurizer used in refining process. Addition of too much manganese will lower the creep rupture strength of the metal. Thus, the manganese content should be limited to 1.0 percent, preferably ranging from 0.3 to 0.8 percent.

(4) Nickel (Ni)

Nickel is an austenite former element which serves to stabilize the austenitic phase at the time of quenching and to prevent the delta-ferrite phase from being produced. These functions will not be able to be fulfilled if the nickel content is less than 0.3 percent. If the content exceeds 2.0 percent, however, the creep rupture strength of the metal will extremely be reduced, and the $Ac_1$ temperature will inevitably be lowered. Thus, the nickel content may range from 0.3 to 2.0 percent, preferably from 0.5 to 1.5 percent, and more preferably from 0.6 to 1.2 percent.

(5) Chromium (Cr)

Chromium is an essential element for the improvement of the creep rupture strength of the steel, serving to prevent oxidation at a high temperature. For these effects, the chromium content needs to be 8.0 percent or more. If the content exceeds 13.0 percent, however, the delta-ferrite phase will be produced. Thus, the chromium content may range from 8.0 to 13.0 percent, preferably from 9.5 to 12.0 percent and more preferably up to 11.0 percent.

(6) Molybdenum (Mo)

Molybdenum is an effective element for the improvement of the creep rupture strength of the steel and for protection against temper embrittlement. These effects require a molybdenum content of 0.5 percent or more. If the content exceeds 2.0 percent, however, the delta-ferrite phase will be produced, and the creep rupture strength and toughness of the metal will be reduced. Thus, the molybdenum content may range from 0.5 to 2.0 percent, preferably from 0.7 to 1.5 percent.

(7) Vanadium (V)

Vanadium is an effective element for the improvement of the creep rupture strength of the steel. This effect can be obtained only if 0.1 percent or more of vanadium is added. If the vanadium content exceeds 0.3 percent, however, delta-ferrite is liable to be produced. Thus, the vanadium content may range from 0.1 to 0.3 percent, preferably from 0.15 to 0.27 percent.

(8) Niobium (Nb) & Tantalum (Ta)

Niobium and tantalum both serve to produce fine grain structure, thereby increasing the ductility and toughness of the steel. The niobium and tantalum also serve to form carbides and carbonitrides, which are dispersedly precipitated as fine particles in a matrix, thereby greatly improving the creep characteristic of the steel. To obtain these effects, it is necessary that the niobium and/or tantalum content(s) are not less than 0.03 percent in total. If the content or contents are 0.3 percent or more in total, however, delta-ferrite will be produced, and the undesirable coarse carbides and carbonitrides will be precipitated. Thus, the niobium and/or tantalum content(s) may range from 0.03 to less than 0.3 percent in total, preferably from 0.10 percent to 0.27 percent.

(9) Nitrogen (N)

Nitrogen is an element which can effectively restrain production of the delta-ferrite phase, and is essential to the formation of carbonitrides of niobium and tantalum. These functions require an addition of 0.01 percent or more of nitrogen. If the nitrogen content exceeds 0.2 percent, however, porosity will possibly be formed in the metal. Thus, the nitrogen content may range from 0.01 to 0.2 percent, preferably from 0.03 to 0.08 percent.

(10) Tungsten (W)

Tungsten serves to improve the creep rupture strength of the steel. This effect requires the tungsten content to exceed 1.1 percent. If the content exceeds 2.0 percent, however, delta-ferrite will inevitably be produced. Thus, the tungsten content may range from over 1.1 to 2.0 percent, preferably up to 1.5 percent.

Having the above described chemical composition, the heat-resisting steel according to the present invention exhibits a satisfactory creep characteristic at a temperature up to about 650° C., and is in no way inferior to conventional ones in other mechanical properties. Accordingly, the heat-resisting steel of the invention is a suitable material for components of steam turbines and the like. Such application would, however, require good fatigue strength and toughness, as well as satisfactory creep strength, of the metal. In order to fulfill these requirements, the heat-resisting steel of the present invention is substantially composed of a tempered martensitic structure containing no ferrite. Considering the creep characteristic, it is to be desired that the metal should contain no ferrite, although a ferrite content of 5 percent or less is negligible.

Ferrite may be prevented from being produced in the metal structure by adjusting the amounts of alloying element added within the aforementioned content ranges. To prevent production of ferrite even in higher quenching temperature, as mentioned later, it is to be desired that the chromium equivalent given by the following expression should range from 6 to 11, preferably from 8 to 11 and more preferably from 9 to 10: chromium equivalent $= -40\times[\%C]-30\times[\%N]-2\times[\%Mn]-4\times[\%Ni]+[\%Cr]+4\times[\%Mo]+6\times[\%Si]+11\times[\%V]+5\times[\%Nb]+2.5\times[\%Ta]+1.5\times[\%W]$.

The heat-resisting steel of the present invention composed in this manner is heated to a temperature of 1,050° to 1,150° C. to be austenitized, rapidly cooled for quenching, and then tempered at a temperature of 600 to 700° C. Thus, the steel substantially has a tempered martensitic structure. Before the tempering at the temperature ranging from 600 to 700° C., the metal may be tempered in advance at 500 to 600° C. to dissolve retained austenite. Also, the tempering may be performed twice at different temperatures within the range from 600 to 700° C.

If the metal is austenitized and quenched at the high temperature ranging from 1,050° to 1,150° C., as described above, carbides, nitrides or carbonitrides of niobium, tantalum and the like can be precipitated in homogeneous, finer particles and in larger quantities. If the austenitization temperature used ranges from 1,050° to 1,150° C., resultant crystalline grain size of austenite will never be coarse. If the chromium equivalent is within the aforesaid range, moreover, production of ferrite can be prevented.

The manufacture of the heat-resisting steel according to the present invention and blades, bolts and other turbine components formed therefrom will now be described in brief.

First, materials mixed in compliance with the content ranges defined according to the present invention are melted in the atmosphere or in a vacuum by the use of a suitable furnace, such as an electric furnace. After the melting, the resultant molten metal is molded into an ingot having a suitable size and shape. Homogenization of components and reduction of impurities can effectively be achieved by additional arc remelting or electroslag remelting of the ingot.

Subsequently, the ingot is heated to a temperature of about 1,150° to 1,200° C. in a heating furnace, such as a fuel oil furnace, electric furnace, or gas furnace, and then forged by a conventional method, e.g., press forging or hammering.

The heat-resisting steel forged in this manner is heated to a temperature of 1,050° to 1,150° C. in the heating furnace. After the whole structure is uniformly austenitized at the temperature kept within this range, it is rapidly cooled for quenching by being thrown into oil or water or by blast cooling.

Thereafter, the heat-resisting steel is heated to an kept at a temperature of 600 to 700° C. in the heating furnace for tempering, thus acquiring a tempered martensitic structure. In order to dissolve the retained austenitic phase existing at the time of quenching, the metal may be tempered at the temperature of 600 to 700° C. after it is previously heated to and kept at a temperature of 500 to 600° C. which is lower than the tempering temperature. Alternatively, tempering may be performed twice at different temperatures within the range of 600 to 700° C.

The heat-resisting steel obtained in this manner is cut into a desired shape e.g., that of a turbine part. If the turbine part is a blade, a forged billet may be cut into a suitable size, heated to a temperature of about 1,100° to 1,200° C., and then dieforged into the shape of a blade. Thereafter, the blade-shaped structure may be quenched, tempered, and then machined into the final size.

Examples according to the present invention will now be described in comparison with controls. Examples 1 to 4 are samples which are prepared in compliance with the content ranges defined according to the invention, while controls 1 and 2 are samples whose compositions do not comply with the content ranges. Controls 1 and 2 correspond to the conventional steels H46 and 422, respectively.

TABLE 1

| | | Alloying Elements (% by weight), iron (remainder) | | | | | | | | | | |
|---|---|---|---|---|---|---|---|---|---|---|---|---|
| | No. | C | Si | Mn | Cr | Mo | V | Ni | Nb | Ta | W | N |
| Examples | 1 | 0.13 | 0.30 | 0.60 | 10.6 | 1.12 | 0.22 | 0.98 | 0.17 | — | 1.18 | 0.06 |
| | 2 | 0.13 | 0.28 | 0.62 | 10.5 | 1.15 | 0.23 | 1.03 | 0.22 | — | 1.22 | 0.07 |
| | 3 | 0.14 | 0.30 | 0.62 | 10.8 | 1.13 | 0.23 | 0.90 | 0.10 | 0.06 | 1.25 | 0.07 |
| | 4 | 0.13 | 0.31 | 0.59 | 10.5 | 1.10 | 0.22 | 0.94 | — | 0.20 | 1.30 | 0.06 |
| Controls | 1 | 0.17 | 0.38 | 0.61 | 11.0 | 1.08 | 0.22 | 0.54 | 0.45 | — | — | 0.05 |
| | 2 | 0.25 | 0.38 | 0.66 | 11.7 | 1.05 | 0.24 | 0.68 | — | — | 0.92 | 0.02 |

TABLE 2

| | | Tensile Characteristic at RT | | | Creep Rupture Time (hr) | |
|---|---|---|---|---|---|---|
| | | | | | AT 600° C. | AT 650° C. |
| | No. | Tensile strength Kg/mm$^2$ | Elongation % | Reduction in area % | applied stress 30 Kg/mm$^2$ | applied stress 20 Kg/mm$^2$ |
| Examples | 1 | 101.9 | 20.1 | 62.3 | 929.0 | 553.0 |
| | 2 | 103.6 | 19.6 | 60.0 | 1030.5 | 494.9 |
| | 3 | 105.0 | 18.3 | 60.0 | 1107.8 | 550.1 |
| | 4 | 100.7 | 21.5 | 61.8 | 867.3 | 463.3 |
| Controls | 1 | 107.5 | 14.7 | 53.0 | 314.5 | 158.6 |
| | 2 | 106.0 | 13.3 | 45.2 | 197.8 | 110.1 |

Materials mixed in accordance with the alloy compositions shown in the columns for examples 1 to 4 and controls 1 and 2 in Table 1 were melted in a high-frequency vacuum smelting furnace. Molten alloys of the individual compositions were cast into dies to be molded into ingots. In mixing the metals, an addition of nitrogen was accomplished by mixing a mother alloy of an Fe-Cr-N system. Then, after their surfaces were shaved away by machining, the ingots were loaded into a fuel oil furnace, heated to 1,200° C., and hammered into round bars with a diameter of 30 mm.

The round bars obtained in this manner were each cut into a length for a test piece used in each of tests mentioned later, and heated to and kept at a temperature of 1,100° C. in an electric furnace for two hours. Thereafter, the bars were thrown into oil of room temperature for quenching, and then heated to and kept at 650° C. in the electric furnace for three hours for tempering.

After the heat treatment, the materials were machined into test pieces, which were used for tension tests and creep rupture tests. The results of these tests are shown in Table 2. The tension tests were conducted at room temperature. Table 2 shows tensile strength, and elongation and reduction of area. The creep rupture tests were conducted under two varied conditions on temperature and load. Table 2 shows rupture times (hours) under the varied conditions.

As seen from the test results shown in Table 2, examples 1 to 4 of the heat-resisting steel according to the present invention can exhibit better creep rupture characteristics for either of temperatures 600° C. and 650° C. than controls 1 and 2 can. Moreover, the tension tests conducted at room temperature (RT) revealed that examples 1 to 4 are substantially equal in tensile strength to and a little better in elongation and reduction of area than controls 1 and 2.

Thus, the heat-resisting steel of the present invention is improved in creep characteristics without spoiling its ductility and toughness at room temperature, and can enjoy very high utility as a material for turbine parts, such as blades and bolts of steam turbines.

What is claimed is:

1. A turbine part which is formed of a heat-resisting chromium steel, said steel essentially consisting of:

a carbon content of 0.13 percent to 0.25 percent by weight;

a silicon content of over 0.2 percent to 1.0 percent by weight;

a manganese content of 1.0 percent or less by weight;

a nickel content of 0.3 percent to 2.0 percent by weight;

a chromium content of 8.0 percent to 11.0 percent by weight;

a molybdenum content of 0.5 percent to 2.0 percent by weight;

a vanadium content of 0.1 percent to 0.3 percent by weight;

niobium and/or tantalum contents of over 0.03 percent to 0.3 percent by weight in total;

a nitrogen content of 0.01 percent to 0.2 percent by weight;

a tungsten content of over 1.1 percent to 2.0 percent by weight; and an iron content basically constituting the remainder, the chromium equivalent given by the following expression being from 9 to 10: chromium equivalent $= -40\times[\%C]-30\times[\%N]-2\times[\%Mn]-4\times[\%Ni]+[\%Cr]+4\times[\%Mo]+6\times[\%Si]+11\times[\%V]+5\times[\%Nb]+2.5\times[\%Ta]+1.5\times[\%W]$;

said steel substantially having a tempered martensitic structure; and said steel having an elongation of not less than 18% and a reduction in area of not less than 60% at room temperature and a creep rupture time of not less than 850 hours at 600° C. with an applied stress of 30 kg/mm$^2$.

2. The turbine part according to claim 1, wherein said carbon content ranges from 0.13 percent to 0.15 percent by weight, said silicon content from over 0.2 percent to 0.6 percent, said manganese content from 0.3 percent to 0.8 percent, said nickel content from over 0.5 percent to 1.5 percent, said chromium content from 9.5 percent to 11.0 percent, said molybdenum content from 0.7 percent to 1.5 percent, said vanadium content from 0.15 percent to 0.27 percent, said niobium and/or tantalum contents from 0.10 to 0.27 percent in total, said nitrogen content from 0.03 percent to 0.08 percent, and said tungsten content from over 1.1 percent to 1.5 percent.

3. The turbine part according to claim 2, wherein said nickel contents ranges from 0.6 percent to 1.2 percent.

4. The turbine part according to claim 1, which is a turbine blade.

5. The turbine part according to claim 1, which is a turbine bolt.

* * * * *